US007844401B2

(12) United States Patent
Reittinger

(10) Patent No.: US 7,844,401 B2
(45) Date of Patent: Nov. 30, 2010

(54) SYSTEM AND METHOD FOR DETERMINING PRODUCIBILITY OF A FORMATION USING FLEXURAL MECHANICAL RESONATOR MEASUREMENTS

(75) Inventor: Peter W. Reittinger, Katy, TX (US)

(73) Assignee: Baker Hushes Incorpated, Houston, TX (US)

( * ) Notice: Subject to any disclaimer, the term of this patent is extended or adjusted under 35 U.S.C. 154(b) by 317 days.

(21) Appl. No.: 12/009,320

(22) Filed: Jan. 17, 2008

(65) Prior Publication Data

US 2008/0215245 A1 Sep. 4, 2008

Related U.S. Application Data

(60) Provisional application No. 60/881,214, filed on Jan. 19, 2007.

(51) Int. Cl.
*G01V 1/40* (2006.01)

(52) U.S. Cl. ..... 702/12

(58) Field of Classification Search ..... 702/6, 702/11, 12, 50, 57, 64, 65, 75, 106, 107, 702/180, 183; 73/32 R, 54.41
See application file for complete search history.

(56) References Cited

U.S. PATENT DOCUMENTS 5,201,215 A * 4/1993 Granstaff et al. ..... 73/54.41
5,741,961 A * 4/1998 Martin et al. ..... 73/32 R
6,336,353 B2 1/2002 Matsiev
6,393,895 B1 5/2002 Matsiev
6,494,079 B1 12/2002 Matsiev
6,904,786 B2 6/2005 Matsiev et al.
6,938,470 B2 9/2005 DiFoggio
6,957,565 B2 10/2005 Matsiev
7,036,375 B2 * 5/2006 Nozaki ..... 73/579
7,043,969 B2 5/2006 Matsiev
7,111,500 B2 9/2006 Itoh et al.
7,162,918 B2 1/2007 DiFoggio et al.
2002/0178787 A1 12/2002 Matsiev
2002/0178805 A1 12/2002 DiFoggio
2003/0041653 A1 3/2003 Matsiev
2004/0074302 A1 4/2004 Matsiev
2004/0074303 A1 4/2004 Matsiev
2004/0244488 A1 12/2004 Tang
2004/0250622 A1 12/2004 Kolosov
2005/0149276 A1 7/2005 Kolosov
2005/0209796 A1 9/2005 Kolosov
2005/0247119 A1 11/2005 DiFoggio
2005/0262944 A1 12/2005 Bennett

* cited by examiner

*Primary Examiner*—Mohamed Charioui
(74) *Attorney, Agent, or Firm*—G. Michael Roebuck

(57) ABSTRACT

The present disclosure presents illustrative embodiments of a method for estimating the producibility of a hydrocarbon bearing formation using a flexural mechanical resonator to measure the viscosity and density of a representative fluid from the formation. A system is disclosed for estimating the producibility of a hydrocarbon bearing formation using a flexural mechanical resonator to measure the viscosity and density of a representative fluid from the formation. A data structure is disclosed for storing data useful for estimating the producibility of a hydrocarbon bearing formation using a flexural mechanical resonator to measure the viscosity and density of a representative fluid from the formation. The data structure provides a structural and functional interrelationship between the data structure, data in the data structure and a computer and computer software provided in an illustrative embodiment.

16 Claims, 8 Drawing Sheets

1300

| 1302 | 1304 | 1306 |
|---|---|---|
| Frequency(0) | TX(0) | RX(0) |
| Frequency(1) | TX(1) | RX(1) |
| . | . | . |
| . | . | . |
| Frequency(40) | TX(40) | RX(40) |

1308

FIG. 13

1400

| 1404 | 1402 |
|---|---|
| Frequency(0) buffer index 0 | RX(0)/TX(0) buffer index 0 |
| Frequency(0) buffer index 1 | RX(0)/TX(0) buffer index 1 |
| Frequency(0) buffer index 2 | RX(0)/TX(0) buffer index 2 |
| Frequency(1) buffer index 0 | RX(1)/TX(1) buffer index 0 |
| Frequency(1) buffer index 1 | RX(1)/TX(1) buffer index 1 |
| Frequency(1) buffer index 2 | RX(1)/TX(1) buffer index 2 |
| . | . |
| . | . |
| Frequency(40) buffer index 0 | RX(40)/TX(40) buffer index 0 |
| Frequency(40) buffer index 1 | RX(40)/TX(40) buffer index 1 |
| Frequency(40) buffer index 2 | RX(40)/TX(40) buffer index 2 |

1408 1406 1410 1412

FIG. 14

SYSTEM AND METHOD FOR DETERMINING PRODUCIBILITY OF A FORMATION USING FLEXURAL MECHANICAL RESONATOR MEASUREMENTS

CROSS REFERENCE TO RELATED APPLICATIONS

This patent application claims priority from U.S. Provisional Patent Application Ser. No. 60/881,214, entitled Simplified Density and Viscosity Calculation from Flexural Mechanical Resonator Measurements, by Peter Reittinger, filed on Jan. 19, 2007, which is hereby incorporated by reference in its entirety.

BACKGROUND

1. Technical Field

The present invention relates to determination of the cost and difficulty of obtaining hydrocarbons from a hydrocarbon bearing formation in the earth using density and viscosity measurements of a liquid sample from the formation.

2. Related Art

As the availability of hydrocarbon deposits in the earth diminish, the cost of obtaining these hydrocarbons from the earth increases. Thus, as the cost increases the economic and social benefit increases for improved products and methods useful for planning when and where to feasibly pursue hydrocarbon production of a reservoir. A particular hydrocarbon reservoir may contain several hydrocarbon bearing formations. These reservoir formations may or may not be connected.

The cost and difficulty of producing or producibility of earth borne hydrocarbons from a reservoir is related to the permeability of the hydrocarbon reservoir or formation in the earth. The producibility, that is, the difficulty and associated costs of obtaining these earth borne hydrocarbons can be determined by testing samples of hydrocarbons from a particular formation. The producibility of a formation is related to the density and viscosity of a hydrocarbon formation fluid sample taken from the formation.

SUMMARY OF THE DISCLOSURE

The present disclosure presents illustrative embodiments of a method for estimating the producibility of a hydrocarbon bearing formation using a flexural mechanical resonator to measure the viscosity and density of a representative fluid from the formation. A system is disclosed for estimating the producibility of a hydrocarbon bearing formation using a flexural mechanical resonator to measure the viscosity and density of a representative fluid from the formation. A data structure is disclosed for storing data useful for estimating the producibility of a hydrocarbon bearing formation using a flexural mechanical resonator to measure the viscosity and density of a representative fluid from the formation. The data structure provides a structural and functional interrelationship between the data structure, data in the data structure and a computer and computer software provided in an illustrative embodiment.

BRIEF DESCRIPTION OF THE DRAWINGS

FIG. 13 is a table of an illustrative embodiment of a data structure for providing a data format for an admittance spectrum from a flexural mechanical resonator which can be processed by an illustrative embodiment of the interpretation technique yielding a density and a viscosity; and FIG. 14 is a table of an illustrative embodiment of data structure for providing data which has been interleaved according to a buffer index as an illustrative embodiment of a technique to minimize measurement time and telemetry bandwidth while maintaining measurement resolution.

DETAILED DESCRIPTION OF ILLUSTRATIVE EMBODIMENTS

Figure 1:
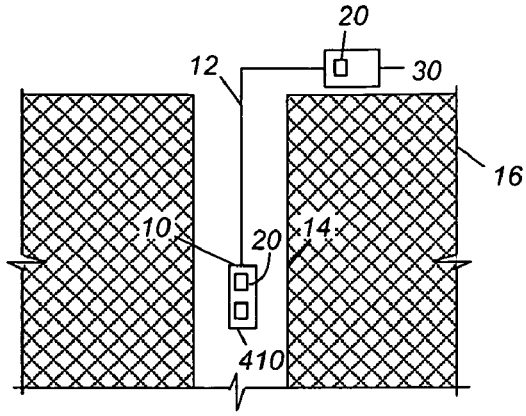
FIG. 1 is a schematic diagram of a particular illustrative embodiment deployed on a wire line in a downhole environment.

The viscosity and density of a reservoir fluid are useful for understanding the cost and producibility of a reservoir or formation in the earth. In an illustrative embodiment, a piezoelectric tuning fork is provided as a flexural mechanical resonator to estimate the viscosity and density of a fluid sample from the formation. A piezoelectric tuning fork has been shown to be an excellent density and viscosity transducer useful for determining the viscosity and density of a reservoir fluid. It has also been established that the electrical equivalent model of a flexural mechanical resonator is a valid model for a piezoelectric tuning fork's response to a fluid's density and viscosity. Yet, the interpretation of the fork's response to an unknown fluid in terms of density and viscosity can be problematic. An exact solution of the electrical equivalent circuit model has been derived to facilitate real-time measurements in the well logging environment.

Some previous interpretation schemes used a non-linear least squares fit of an electrically equivalent model to data representing flexural mechanical resonator measurements in a formation fluid. An illustrative embodiment derives density and viscosity values from the relative frequency shifts of peaks and zero crossings in the spectra. The non-linear least squares fitting routines relied upon close initial guesses for the density and viscosity being measured. If these guesses are not close enough to the correct values, the least squares fit interpretation can converge to completely erroneous values. An illustrative embodiment uses no prior information about the densities and viscosities being measured and its accuracy is limited only by the frequency resolution of the measured spectra. The non-linear least squares fitting interpretation also relies upon accurate measurements of the impedance or admittance of the resonator before it can converge to a correct solution, making the interpretation susceptible to stray capacitances. An illustrative embodiment is less susceptible to the effects of stray capacitances because it is based upon only the frequencies at which the flexural mechanical resonator undergoes motional resonance.

In another particular embodiment a method for estimating a property of a fluid down hole is disclosed, the method comprising immersing a resonator in the fluid downhole; sweeping an input voltage to the resonator over a frequency range; measuring an electrical current output from the resonator over the frequency range; determining admittance spectrum values for the resonator as the ratio of the electrical output current over the input voltage over the frequency range; determining a first frequency for the admittance spectrum; determining a second frequency for the admittance spectrum; and estimating the property for the fluid down hole from the first and second frequencies. In another embodiment of the method, the admittance spectrum values are real and imaginary components of measured admittance values; and the first frequency is a frequency at which an imaginary component of the admittance spectrum values is at a maximum and the second frequency is a frequency at which a real component of the admittance spectrum values is at a maximum value.

In another embodiment of the method, the admittance spectrum values are magnitudes of measured admittance values; and the first frequency is a frequency at which the magnitude of the admittance is at a maximum and wherein the second frequency is a frequency at which the magnitude of the admittance spectrum values crosses a baseline. In another embodiment of the method, the admittance spectrum values further comprise a difference between measured admittance values and a shunt admittance value due to stray capacitance. In another embodiment of the method, the shunt admittance value is calculated as an average value of an imaginary component of the admittance spectrum. In another embodiment of the method, the shunt admittance value is calculated as an average value of the magnitudes of the measured admittance values. In another embodiment of the method, the property of the fluid is selected from the group consisting of density and viscosity.

In another embodiment of the method, the method further includes subtracting a shunt admittance value from squared values of the magnitude of the measured admittance to calculate baseline corrected admittance values, wherein the first frequency is the frequency at which the baseline corrected admittance values crosses zero and the second frequency is a frequency at which the baseline corrected admittance has a maximum value. In another embodiment of the method, the method further includes estimating the property of the fluid by comparing the first frequency and the second frequency to frequencies stored in a data structure wherein the data structure indicates the fluid properties associated with the first and second frequency.

In another embodiment a system for estimating a property of a fluid down hole, the system comprising a resonator immersed in the fluid downhole; a processor in data communication with the resonator; a voltage source electrically connected to the resonator that provides a swept input voltage to the resonator over a frequency range; a sensor for measuring an electrical current output from the resonator over the frequency range; a processor in data communication with the resonator; and a computer program comprising computer executable instructions to determine admittance spectrum values for the resonator as the ratio of the electrical output current over the input voltage over the frequency range, instructions to determine a first frequency for the admittance spectrum; instructions to determine a second frequency for the admittance spectrum; and instructions to estimate the property for the fluid down hole from the first and second frequencies. In another embodiment of the system, the computer program further includes instructions to process the measured admittance values as real and imaginary components, wherein the first frequency is a frequency at which an imaginary component of the admittance spectrum is at a maximum and the second frequency is a frequency at which a real component of the admittance spectrum is at a maximum value.

In another embodiment of the system, the computer program further includes instructions to, calculate the magnitudes of measured admittance values, wherein the first frequency is a frequency at which the magnitude of the admittance is at a maximum and the second frequency is a frequency at which the magnitude of the admittance values crosses a baseline. In another embodiment of the method, the method further includes the admittance spectrum values further comprise a difference between measured admittance values and a shunt admittance value due to stray capacitance. In another embodiment of the system, the shunt admittance value is calculated as an average value of an imaginary component of the admittance spectrum. In another embodiment of the system, the shunt admittance value is calculated as an average value of the magnitudes of the measured admittance values. In another embodiment of the system, the property of the fluid is selected from the group consisting of density and viscosity.

In another embodiment of the system, the computer program further includes instructions to subtract a shunt admittance value from squared values of the magnitude of the measured admittance to calculate baseline corrected admittance values, wherein the first frequency is the frequency at which the baseline corrected admittance crosses zero and the second frequency is a frequency at which the baseline corrected admittance has a maximum value. In another embodiment of the system, the computer program further comprising instructions to estimate the property of the fluid by comparing the first frequency and the second frequency to frequencies stored in a data structure, wherein the data structure indicates the fluid properties associated with the first and second frequency.

An illustrative embodiment relies upon the measurement of resonant frequencies from impedance or admittance spectra, but the frequencies can also be measured directly by using the resonator as a filter of a wideband source. Interpolation algorithms may be employed to improve the resolution of the measurement, and the interpretation can be extended to include measurements of the real and imaginary components of the resonators admittance.

A particular illustrative embodiment provides a downhole method and apparatus using a mechanical resonator, for example, a tuning fork to provide real-time direct measurements and estimates of the viscosity, density and dielectric constant of a formation fluid or filtrate in a hydrocarbon producing well. A particular illustrative embodiment additionally provides a system and method for 1) monitoring cleanup from a leveling off of viscosity or density over time, 2) measuring or estimating bubble point for formation fluid or filtrate, 3) measuring or estimating dew point for formation fluid or filtrate, 4) the onset of asphaltene precipitation, and 5) intercalibration of a plurality of pressure gauges used to determine a pressure differential downhole. Each of these applications of particular illustrative embodiments contributes to the commercial value of downhole monitoring while drilling and wire line tools.

Another particular illustrative embodiment enables the direct measurement of viscosity so that permeability can be determined from the measured mobility. In a particular illustrative embodiment, a downhole tool is provided for estimating, storing or displaying the properties of a formation or a formation fluid sample. In an illustrative embodiment, a tool deployed in a well bore formed in an adjacent formation, the tool communicating and interacting with a quantity of downhole fluid from the formation, a mechanical resonator attached to the tool immersed in the fluid sample, a controller for actuating the mechanical resonator; and a monitor for receiving a response from the mechanical resonator to actuation of the mechanical resonator in the fluid. In another aspect of another particular illustrative embodiment a tool is provided further comprising a processor for determining a characteristic of a fluid sample or the formation from the response of the mechanical resonator.

In another aspect of another particular illustrative embodiment a tool is provided wherein at least one of density, viscosity or dielectric constant are determined for a formation sample. In another aspect of another particular illustrative embodiment a tool is provided wherein the characteristic of said fluid is used to determine the dew point of said fluid. In another aspect of another particular illustrative embodiment a tool is provided wherein the characteristic of the formation fluid is used to determine the bubble point of the fluid sample. In another aspect of another particular illustrative embodiment a tool is provided where in the characteristic of the fluid is used to monitor the cleanup over time while pumping. In another aspect of another particular illustrative embodiment a tool is provided to determine the dew point of a down hole formation fluid sample.

In another aspect of another particular illustrative embodiment a tool is provided wherein the characteristic of the fluid sample is used to determine the onset of asphaltene precipitation. In another aspect of another particular illustrative embodiment a tool is provided wherein the characteristic of the fluid sample is used to estimate NMR decay times T1 and T2, which are inversely correlated to viscosity. In another aspect of another particular illustrative embodiment a tool is provided further comprising a plurality of pressure gauges that are a known vertical separation distance apart in the fluid, wherein the mechanical resonator response is used to measure the density of the fluid to calculate the correct pressure difference for the vertical separation.

In another aspect of another particular illustrative embodiment, the mechanical resonator is actuated electrically. In a particular illustrative embodiment, the resonator is made of quartz and has metallic electrodes deposited on two or more of the resonator faces. In another particular illustrative embodiment, the resonator is made of lithium niobate and the metallic electrodes embedded or sandwiched within the body of the resonator. The electrodes are epoxy coated to prevent corrosion of the contacts. In another aspect of another particular illustrative embodiment, the mechanical resonator is placed in a cavity outside the direct flow path to protect the tuning fork from damage from debris passing in the sample flow path.

In another particular illustrative embodiment, a hard or inorganic coating is placed on the flexural mechanical resonator (such as a tuning fork) to reduce the effects of abrasion from sand particles suspended in the flowing fluid in which the flexural mechanical resonator is immersed. In another particular illustrative embodiment, the coating on the flexural mechanical resonator can have a very low surface energy to reduce the quantity of particles or films adhering to the surface.

In an illustrative embodiment, the piezoelectric tuning fork measurement involves driving the tuning fork with an AC signal that is swept through its resonant frequency. The response of the tuning fork as a function of frequency, also known as the tuning fork's spectrum, is then interpreted in terms of density and viscosity by using the electrical equivalent circuit model. In the past, tuning fork spectra have been interpreted by fitting this model to the data with a numerical technique known as non-linear least squares curve fitting. This non-linear technique utilizes initial estimates for the parameters being fitted, in this case density and viscosity, to ensure convergence to a correct solution.

A characteristic of this technique is that it can converge to a wrong answer if the initial estimates are not "close enough" to the correct answer. The fluids encountered in a downhole environment can span a wide range of densities (0-2 g/cc) and viscosities (0-100 cPs) making it difficult for a single initial estimate to be always "close enough". Other aspects of a well logging application also hinder the non-linear least squares curve fit, such as: limited processing power downhole makes it desirable to telemeter raw data to a processing computer resulting in sparse data sets, and multi-phase fluids (fluids comprised of separate regions of gas, fluid and particulate) flowing past the sensor result in incomplete or "noisy" or erratic intensity shifts in the measured spectra.

In an illustrative embodiment, to simplify interpretation a more exact solution for density and viscosity from key features of the tuning fork spectrum is presented. The illustrative embodiment provides a result that is a more robust interpretation technique better suited to a well logging application.

Figure 2:
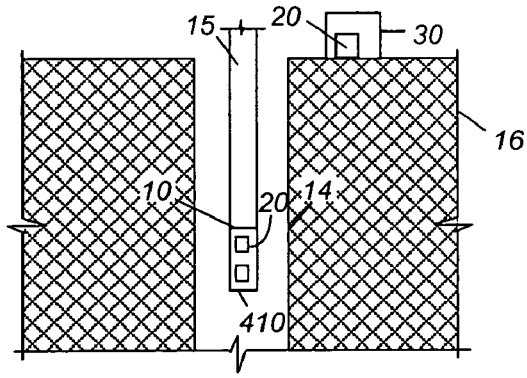
FIG. 2 is a schematic diagram of another particular illustrative embodiment deployed on a drill string in a monitoring while drilling environment.
Figure 3:
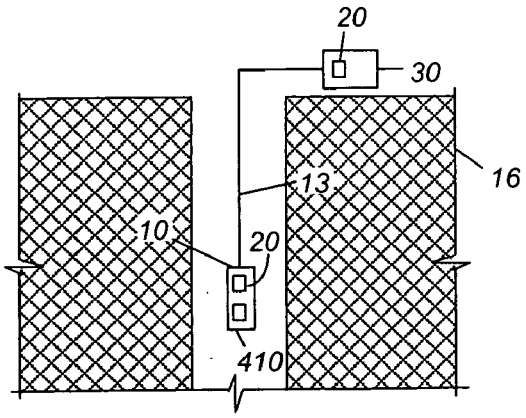
FIG. 3 is a schematic diagram of another particular illustrative embodiment deployed on a flexible tubing in a downhole environment.

FIG. 1 is a schematic diagram of a particular illustrative embodiment deployed on a wire line in a downhole environment. As shown in FIG. 1, a downhole tool 10 containing a mechanical resonator 410 is deployed in a borehole 14. The borehole is formed in formation 16. Tool 10 is deployed via a wire line 12. Data from the tool 10 is communicated to the surface from a computer processor 20 including computer readable medias and embedded data structures in memory to a similar but more powerful processor 20 inside of an intelligent completion system 30. FIG. 2 is a schematic diagram of an embodiment of another particular illustrative embodiment deployed on a drill string 15 in a monitoring while drilling environment. FIG. 3 is a schematic diagram of an embodiment of another particular illustrative embodiment deployed on a flexible tubing 13 in a downhole environment.

Figure 4:
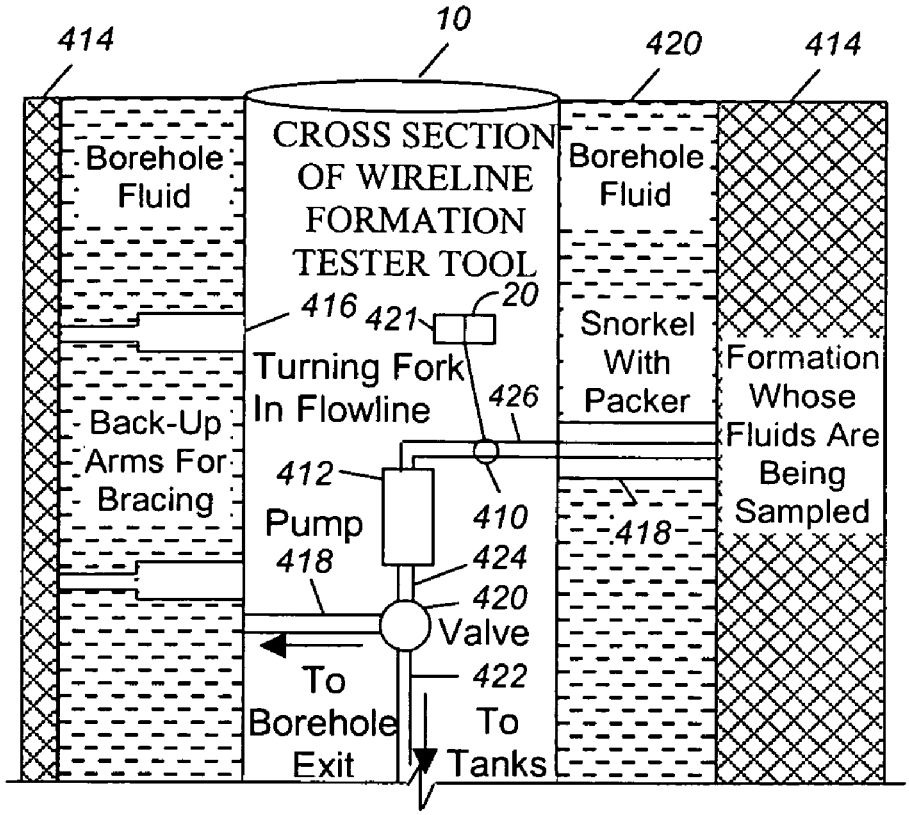
FIG. 4 is a schematic diagram of another particular illustrative embodiment as deployed in a wire line downhole environment showing a cross section of a wire line formation tester tool.

FIG. 4 is a schematic diagram of an embodiment of another particular illustrative embodiment as deployed in a wire line downhole environment showing a cross section of a wire line formation tester tool. As shown in FIG. 4, tool 10 is deployed in a borehole 420 filled with borehole fluid. The tool 10 is positioned in the borehole by backup support arms 416. A packer with a snorkel 418 contacts the borehole wall for extracting formation fluid from the formation 414. Tool 416 contains tuning fork 410 disposed in flow line 426. Any type of flexural mechanical oscillator is suitable for deployment in the tool of another particular illustrative embodiment. The processor 20 with computer readable media memory is shown along with tuning fork exciter circuit 421.

The mechanical oscillator, shown in FIG. 4 as a tuning fork 410 is excited by the exciter circuit 421 which provides an electric current applied to its electrodes and monitored to determine density, viscosity and dielectric coefficient of the formation fluid. The exciter circuit 421 electronics for exciting and monitoring the flexural mechanical resonator 410 are housed in the tool 10. Pump 412 pumps formation fluid from formation 414 into flow line 426. Formation fluid travels through flow line 424 in into valve 420 which directs the formation fluid to line 422 to save the fluid in sample tanks or to line 418 where the formation fluid exits to the borehole. The tuning fork is excited and its response in the presence of a formation fluid sample is utilized to determine fluid density, viscosity and dielectric coefficient while fluid is pumped by pump 412 or while the fluid is static, that is, when pump 412 is stopped.

Figure 6:
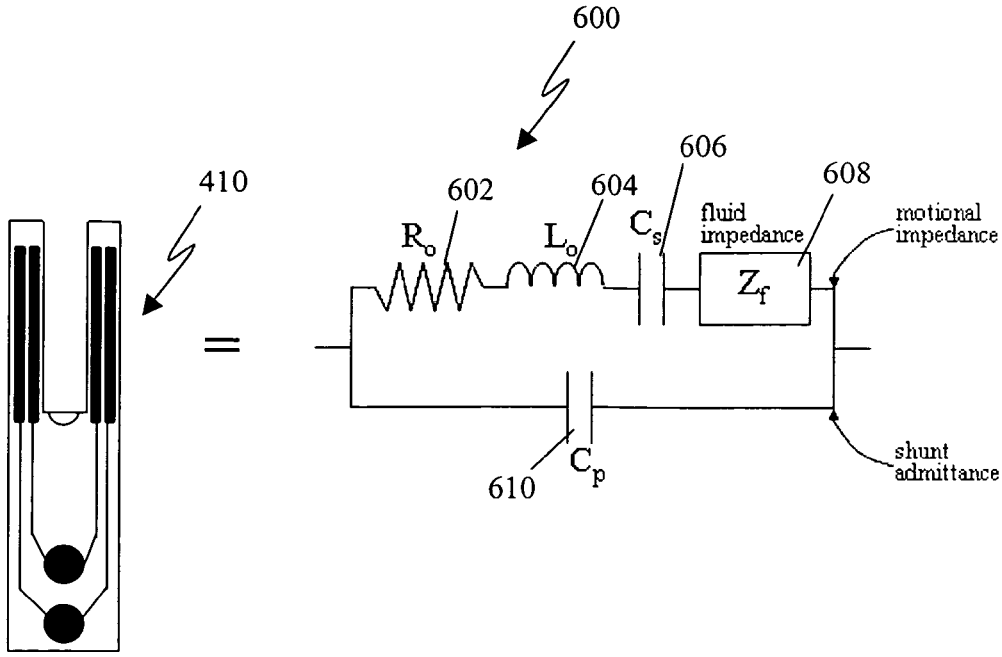
FIG. 6 is a schematic illustration of an equivalent model of a piezoelectric tuning fork provided in an illustrative embodiment.

The interpretation of the piezoelectric tuning fork measurement starts with an electrical equivalent model, shown in FIG. 6. $R_o$ 602, $L_o$ 604, and $C_s$ 606 are the equivalent series resistance, inductance, and capacitance that model the electro-mechanical resonance of a piezoelectric transducer 410. These parameters could also be electrical analogs of mechanical parameters for a flexural mechanical resonator; $R_o$ 602 represents friction, $L_o$ 604 represents mass, and $C_s$ 606 represents compliance. $C_p$ 610 is the total parasitic capacitance that shunts current around the piezoelectric transducer, or it could represent anything that reduces the force applied to a mechanical resonator 410. Together, these parameters define the motional impedance of the flexural mechanical resonator, $Z_m$, which relates the electrical impedance of a piezoelectric transducer to the simple harmonic oscillation of a flexural mechanical resonator.

$$Z_m = R_o + j\left(\omega L_o - \frac{1}{\omega C_S}\right) + Z_f \qquad \text{Eq. 1}$$

FIG. 6 illustrates an electrical equivalent model of piezoelectric tuning fork. When the tuning fork is immersed in a fluid it behaves like a damped simple harmonic oscillator. This effect is modeled in equation 1 by adding a damping term, the fluid impedance $Z_f$ 608, to the motional impedance.

$$Z_f = B\sqrt{\rho\eta\omega} + j(A\rho\omega + B\sqrt{\rho\eta\omega}) \qquad \text{Eq. 2}$$

The A coefficient in the fluid impedance relates fluid density, ρ, to an effective increase of resonator mass when oscillating at frequency ω in the fluid. The B coefficient relates the fluid's density-viscosity product, ρη, to viscous damping of the resonator by the fluid.

It is convenient to describe the tuning fork response in terms of admittance, which is the reciprocal of impedance. The total admittance of the tuning fork, $Y_t$, is the ratio of current flowing through the device in response to an applied voltage. It is also the sum of the motional and shunt admittances in the tuning fork. $Y_t$ could also represent the velocity of a mechanical resonator resulting from an applied force.

$$\begin{aligned} Y_t &= \frac{I_{out}}{V_{in}} \\ &= \frac{1}{Z_m} + j\omega C_p \\ &= \frac{\left(R_o + B\sqrt{\rho\eta\omega}\right) - j\left(A\rho\omega + L_o\omega + B\sqrt{\rho\eta\omega} - \frac{1}{\omega C_s}\right)}{\left(R_o + B\sqrt{\rho\eta\omega}\right)^2 + \left(A\rho\omega + L_o\omega + B\sqrt{\rho\eta\omega} - \frac{1}{\omega C_s}\right)^2} + \\ &\quad j\omega C_p \end{aligned} \qquad \text{Eq. 3}$$

Figure 7:
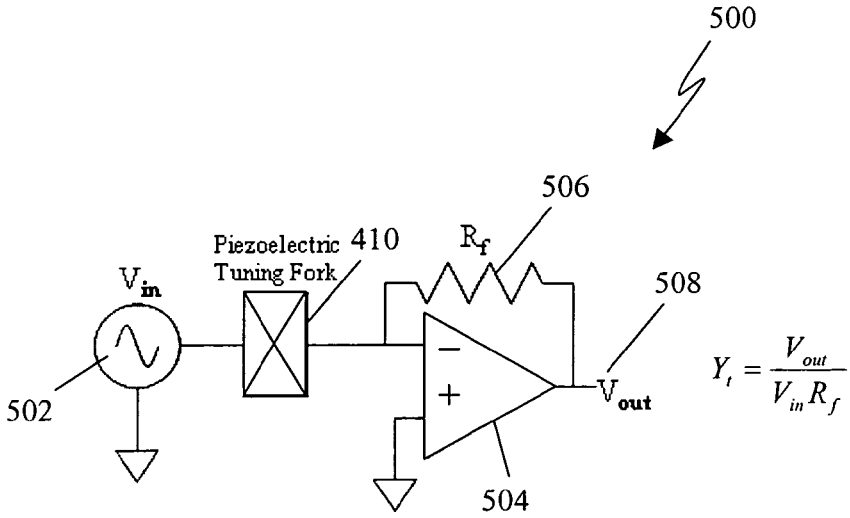
FIG. 7 is a schematic illustration of a current to voltage converter provided in an illustrative embodiment.

The admittance of a piezoelectric tuning fork can be measured with a current to voltage converter as shown in FIG. 7. If the input voltage, $V_{in}$ 502, is supplied by a swept frequency voltage source from exciter and monitoring circuit electronics 421, the admittance of the tuning fork can be measured as a function of frequency, $Y_t(\omega)=V_{out}(\omega)/(V_{in}(\omega)R_f)$, which is an admittance spectrum. Amplifier 504 and feed back resistor 506 are used to condition a current response from the tuning fork 410 to produce a voltage Vout 508. An admittance spectrum that shows the resonance of a piezoelectric tuning fork immersed in a fluid can be used to estimate the density and viscosity of the fluid. An admittance spectrum of this resonance can be fit to the electrical equivalent model of the tuning fork using a non-linear least squares curve fit, but this technique is subject to all of the limitations listed previously. An illustrative embodiment provides an alternate interpretation technique described herein that derives the density and viscosity of the fluid from two key features of the tuning fork resonance. The illustrative embodiment provides a more exact solution for the unknowns with a substantially less amount of processing and data points by measuring two frequencies; one frequency at which the imaginary component of the tuning fork's motional admittance, $\mathrm{Im}(Y_t)$ 802, is at a maximum 804, and the second frequency at which the real component of this admittance, $\mathrm{Re}(Y_t)$ 806, is at a maximum 808 as shown in FIG. 8.

FIG. 7 is a schematic depiction of an illustrative embodiment of a current to voltage converter. The circuit shown in FIG. 7 measures the total tuning fork admittance, $Y_t(\omega)$, which can be expressed in real and imaginary components as shown in FIG. 8. The difference between the measured total admittance and the motional admittance needed for interpretation is the offset and slope of the imaginary component, which is the shunt admittance due to the stray capacitance $C_p$ 810. This shunt admittance can be subtracted from $\mathrm{Im}(Y_t)$, to yield the imaginary component of the motional admittance, $\mathrm{Im}(Y_m)$ 902, as shown in FIG. 9. The real component of the motional admittance, $\mathrm{Re}(Y_m)$ 904, is equal to $\mathrm{Re}(Y_t)$ 806. Because of the symmetry of $\mathrm{Im}(Y_t)$, an estimate of the shunt admittance can be calculated as the average value of $\mathrm{Im}(Y_t)$. If the admittance spectrum is measured at n discrete frequencies $$C_{p-estimate} = \frac{\sum_{i=1}^{n} \frac{\mathrm{Im}(Y_t)[i]}{\omega[i]}}{n}, \qquad \text{Eq. 4}$$

and $$\mathrm{Im}(Y_m)[i] = \mathrm{Im}(Y_t)[i] - \omega[i]C_{p-estimate} \qquad \text{Eq. 5}$$

Figure 8:
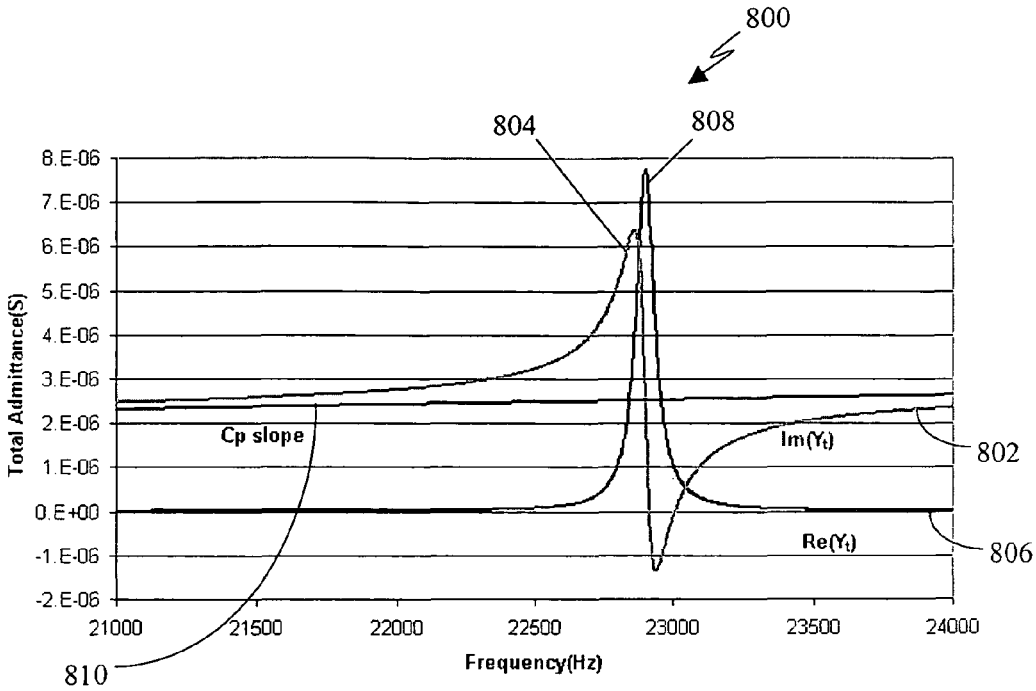
FIG. 8 is an illustration of a plot of total tuning fork admittance spectra shown as real and imaginary components in an illustrative embodiment. The shunt admittance due to the stray capacitance, $C_p$, is shown so that its contribution to the imaginary component of the admittance can be seen in an illustrative embodiment.
Figure 9:
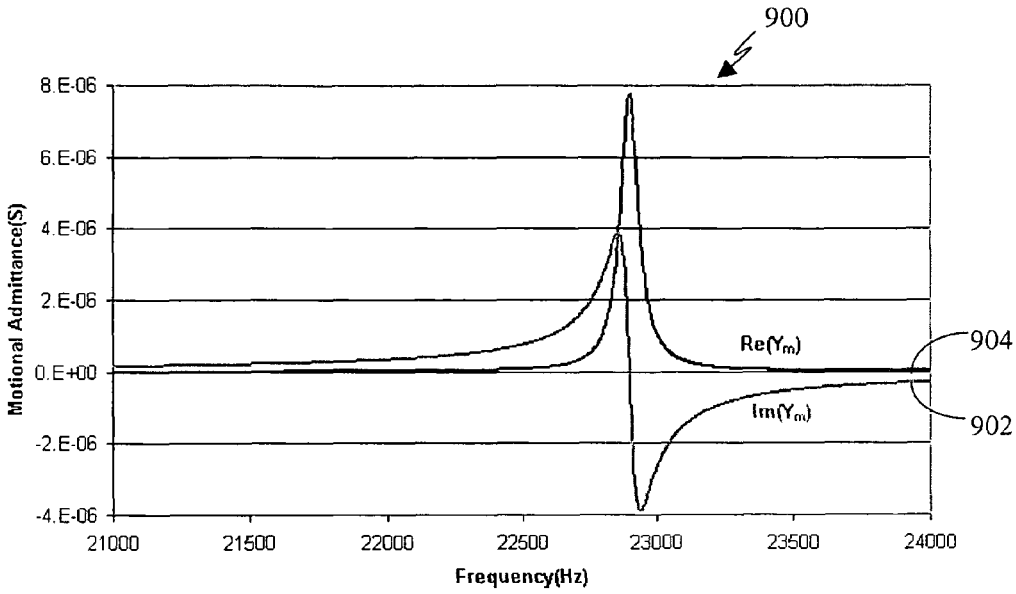
FIG. 9 is an illustration of when the $C_p$ slope is subtracted from the imaginary component of the tuning fork admittance, $\mathrm{Im}(Y_t)$ shown in FIG. 8, the difference is equal to the imaginary component of the motional admittance $\mathrm{Im}(Y_m)$ in an illustrative embodiment.

FIG. 8 illustrates that in an illustrative embodiment, the total tuning fork admittance spectra is shown as real and imaginary components. The shunt admittance due to the stray capacitance, $C_p$ 810, is shown so that its contribution to the imaginary component of the admittance can be seen. FIG. 9 illustrates that when, in an illustrative embodiment, the $C_p$ slope 810 is subtracted from the imaginary component of the tuning fork admittance, $\mathrm{Im}(Y_t)$ 802 shown in FIG. 8, the difference is equal to the imaginary component of the motional admittance $\mathrm{Im}(Y_m)$ 902.

Figure 10:
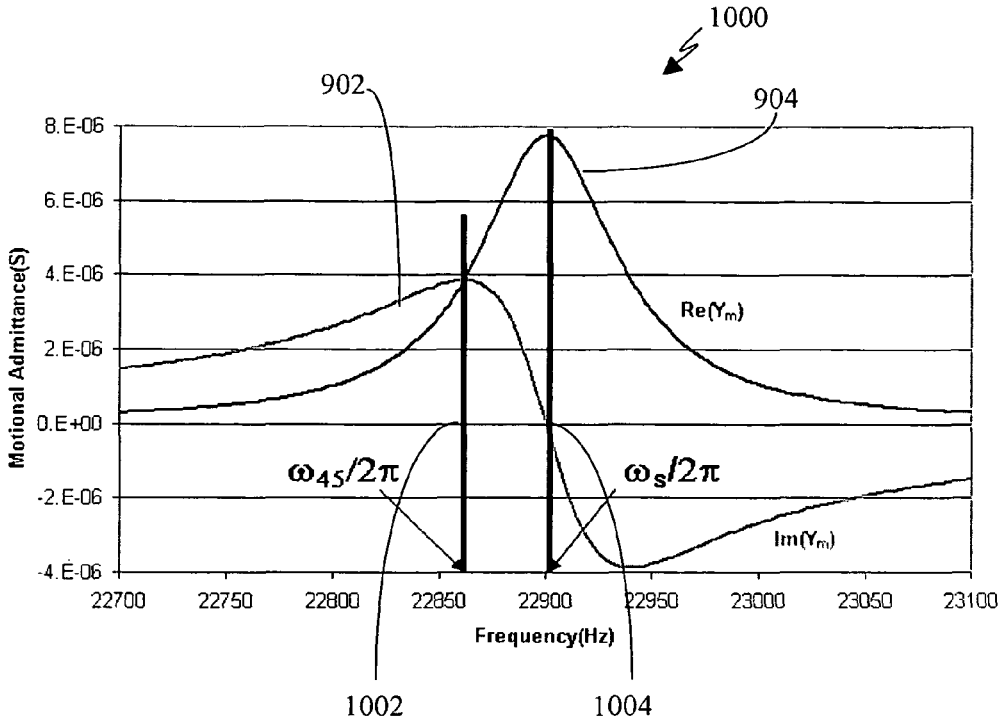
FIG. 10 is an illustration of an illustrative embodiment of a plot of real and imaginary components of the motional admittance with the frequencies defined as $\omega_s$ and $\omega_{45}$ indicated of an illustrative embodiment.

FIG. 10 illustrates that in an illustrative embodiment, the real and imaginary components of the motional admittance with the frequencies defined as $\omega_S$ 1002 and $\omega_{45}$ 1004 indicated.

Given the components of the motional admittance shown in FIG. 9, a density and viscosity value can be estimated from the frequencies at which the components have maximum values as shown in FIG. 10. From the standpoint of the measurement, the signal to noise ratio is substantially optimal at these frequencies because they occur when the in-phase and quadrature current being detected are at their maxima. The frequency where $\mathrm{Re}(Y_m)$ 904 is maximum will be referred to as $\omega_S$ 1004, because this is the series resonance frequency. The frequency where $\mathrm{Im}(Y_m)$ 902 is maximum will be referred to as $\omega_{45}$ 1002, because this is the frequency where the real and imaginary components are equal, implying a 45 degree phase shift in the current being measured. From equation 3 it can be seen that $$\mathrm{Re}(Y_m) = \frac{(R_o + B\sqrt{\rho\eta\omega})}{(R_o + B\sqrt{\rho\eta\omega})^2 + \left(A\rho\omega + L_o\omega + B\sqrt{\rho\eta\omega} - \frac{1}{\omega C_s}\right)^2} \quad \text{Eq. 6}$$

$$\mathrm{Im}(Y_m) = \frac{-\left(A\rho\omega + L_o\omega + B\sqrt{\rho\eta\omega} - \frac{1}{\omega C_s}\right)}{(R_o + B\sqrt{\rho\eta\omega})^2 + \left(A\rho\omega + L_o\omega + B\sqrt{\rho\eta\omega} - \frac{1}{\omega C_s}\right)^2} \quad \text{Eq. 7}$$

Since we know the density of a vacuum is zero, and $\mathrm{Im}(Y_m)$ equals zero at series resonance, one can calibrate the tuning fork in a vacuum.

$$\mathrm{Im}(Y_m)_{vac} = \frac{-L_o\omega_{s-vac} + \frac{1}{\omega_{s-vac}C_s}}{R_o^2 + \left(L_o\omega_{s-vac} - \frac{1}{\omega_{s-vac}C_s}\right)^2} \quad \text{Eq. 8}$$

$$\omega_{s-vac}^2 = \frac{1}{L_o C_s} \quad \text{Eq. 9}$$

Similarly, since $\mathrm{Re}(Y_m)$ is equal to $\mathrm{Im}(Y_m)$ at frequency $\omega_{45}$, in a vacuum, equations 6 and 7 yield $$\omega_{45-vac} = \frac{R_o}{2L_o}\left(\sqrt{1 + 4\frac{L_o}{R_o^2 C_s}} - 1\right) \cong \frac{1}{\sqrt{L_o C_s}} - \frac{R_o}{2L_o}. \quad \text{Eq. 10}$$

The approximation in equation 10 is reasonable because $L_O \infty 10^3$, $R_O \sim 10^4$, and $C_s \sim 10^{-13}$. From these definitions of $\omega_s$ and $\omega_{45}$, equations 6 and 7 can be rewritten as follows.

$$1 + \frac{A}{L_o}\rho + \frac{B}{L_o}\sqrt{\frac{\rho\eta}{\omega_s}} = \frac{1}{\omega_s^2 C_s L_o} = \left(\frac{\omega_{s-vac}}{\omega_s}\right)^2 \quad \text{Eq. 11}$$

$$1 + \frac{A}{L_o}\rho + 2\frac{B}{L_o}\sqrt{\frac{\rho\eta}{\omega_{45}}} = \frac{1}{\omega_{45}^2 C_s L_o} - \frac{R_o}{\omega_{45} L_o} = \left(\frac{\omega_{s-vac}}{\omega_{45}}\right)^2 - 2\frac{\omega_{s-vac} - \omega_{45-vac}}{\omega_{45}} \quad \text{Eq. 12}$$

Equations 11 and 12 can then be solved for density, ρ, and viscosity, η, where $$\rho\eta = \left[\frac{\left(\frac{\omega_{s-vac}}{\omega_{45}}\right)^2 - \left(\frac{\omega_{s-vac}}{\omega_s}\right)^2 - 2\left(\frac{\omega_{s-vac} - \omega_{45-vac}}{\omega_{45}}\right)}{\frac{B}{L_o}\left(\frac{2}{\sqrt{\omega_{45}}} - \frac{1}{\sqrt{\omega_s}}\right)}\right]^2 \quad \text{Eq. 13}$$

$$\rho = \left(\frac{\left(\frac{\omega_{s-vac}}{\omega_s}\right)^2 - \frac{B}{L_o}\sqrt{\frac{\rho\eta}{\omega_s}} - 1}{\frac{A}{L_o}}\right) \quad \text{Eq. 14}$$

The coefficients A and B in equations 13 and 14 are then determined by measuring $\omega_s$ and $\omega_{45}$ for a tuning fork immersed in a calibration fluid having known density and viscosity. This solution requires no a priori information about the density and viscosity being measured. Moreover, as $\omega_s$ is always larger than $\omega_{45}$ so there is a substantially reduced possibility of an undefined result.

Figure 11:
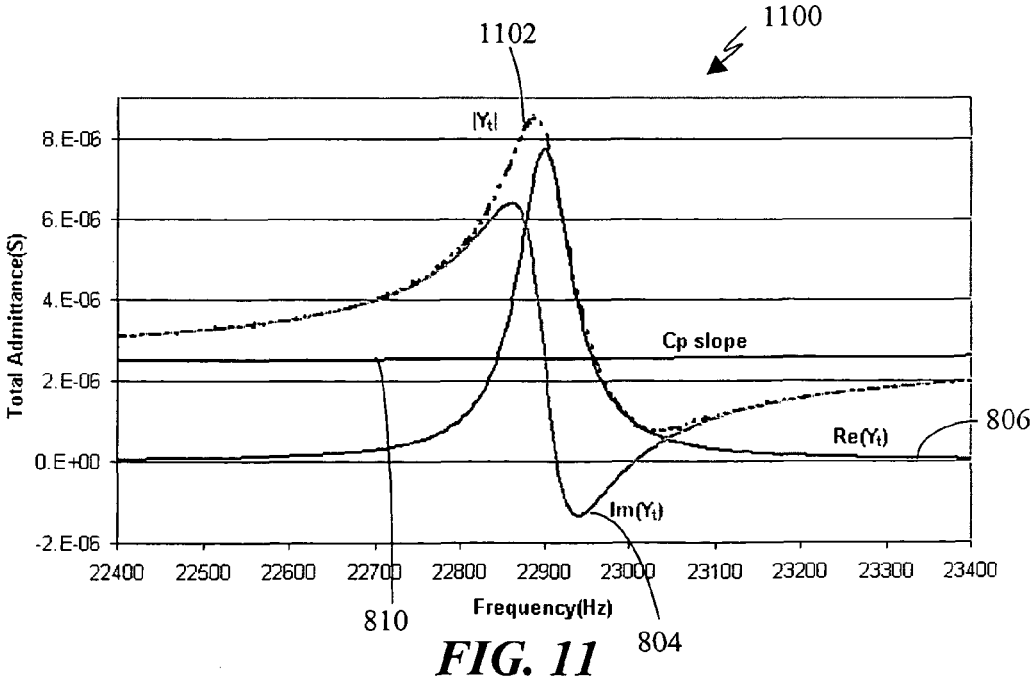
FIG. 11 is an illustration of a plot of a magnitude of $Y_t$ is plotted along with the Real and Imaginary components of $Y_t$ of an illustrative embodiment.

The magnitude of the tuning fork admittance can be interpreted similarly. It is not necessary to provide a phase sensitive detector to measure the magnitude of the admittance, which simplifies the hardware requirements. For example, the output from the circuit shown in FIG. 7 can be taken directly to an RMS converter, which will have a DC output proportional to the magnitude of the tuning fork admittance. If this data is telemetered to an acquisition computer, the magnitude measurement data utilizes only half the bandwidth of the real and imaginary component measurement data. For the same bandwidth the magnitude measurement can have twice the resolution of the component measurement. FIG. 11 illustrates an overlay of the magnitude of $Y_t$ 1102 with the real 806 and imaginary 804 components of $Y_t$ of an illustrative embodiment from which it can be seen that the slope and offset of the magnitude spectrum 1102 is equivalent to the slope and offset of the imaginary component 804. Therefore, the contribution of the shunt admittance 810 to the magnitude 1102 can be subtracted. To simplify the math, the magnitude is squared before processing.

Starting with equation 3, $$|Y_t|^2 = Y_t Y_t^* = \frac{(R_o + B\sqrt{\rho\eta\omega})^2 + \left(A\rho\omega + L_o\omega + B\sqrt{\rho\eta\omega} - \frac{1}{\omega C_s} - \omega C_p D\right)^2}{D^2} \quad \text{Eq. 15}$$

Where $$D = (R_o + B\sqrt{\rho\eta\omega})^2 + \left(A\rho\omega + L_o\omega + B\sqrt{\rho\eta\omega} - \frac{1}{\omega C_s}\right)^2 \quad \text{Eq. 16}$$

-continued $$|Y_t|^2 - (\omega C_p)^2 = \frac{1 - 2\omega C_p\left(A\rho\omega + L_o\omega + B\sqrt{\rho\eta\omega} - \frac{1}{\omega C_s}\right)}{D} \quad \text{Eq. 17}$$

Figure 12:
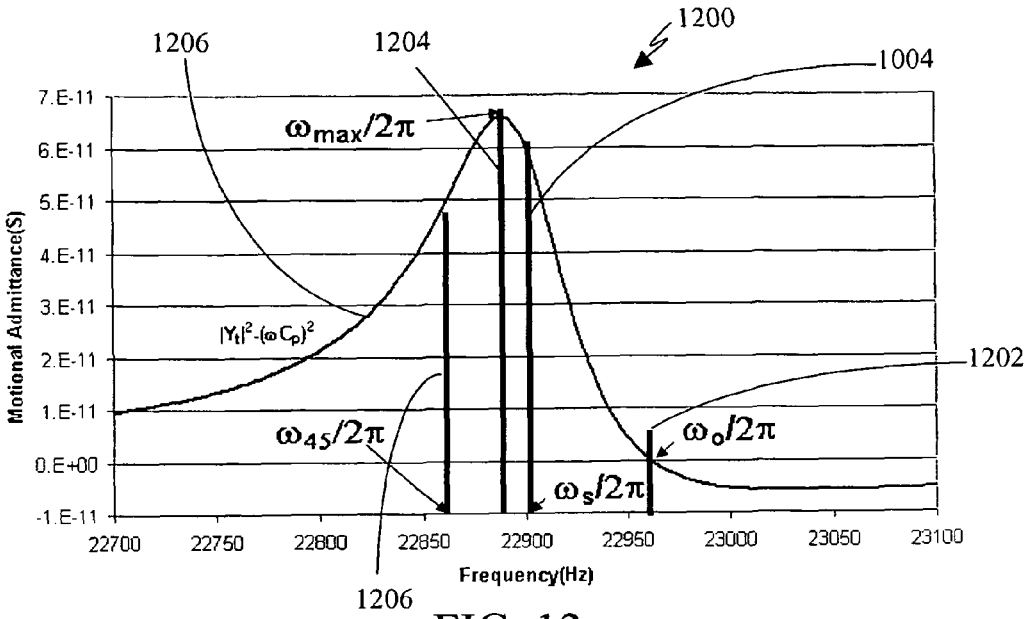
FIG. 12 illustrates a plot of a baseline-corrected square of the magnitude spectrum showing that $\omega_s$ and $\omega_{45}$ are no longer obvious in the data in an illustrative embodiment. The frequencies of the maximum value, $\omega_{max}$, and the zero crossing, $\omega_o$, were chosen for interpretation instead.

FIG. 12 is a plot of an illustrative embodiment of a baseline-corrected square of the magnitude spectrum 1206 showing that $\omega_s$ 1004 and $\omega_{45}$ 1002 are no longer obvious in the data. Therefore two new frequencies are defined: $\omega_o$ 1202 where the baseline corrected square of the magnitude crosses zero, and $\omega_{max}$ 1204 where this spectrum has a maximum value. At $\omega_{max}$ 1204 the signal to noise ratio for the measurement is at a maximum. And the slope in the vicinity of the zero crossing is steep, making the error in $\omega_o$ due to noise very small.

When a tuning fork is in a vacuum, the density is zero, so from equation 17 and the definition of $\omega_o$ $$\omega_{o-vac}^2 = \frac{1}{L_oC_s} + \frac{1}{2L_oC_p} \quad \text{Eq. 18}$$

$$1 + \frac{A}{L_o}\rho + \frac{B}{L_o}\sqrt{\frac{\rho\eta}{\omega_o}} = \left(\frac{\omega_{o-vac}}{\omega_o}\right)^2 \quad \text{Eq. 19}$$

From equation 15 and the definition of $\omega_{max}$ it follows that $$\left(R_o + B\sqrt{\rho\eta\omega_{max}}\right)^2 - \left(A\rho\omega_{max} + L_o\omega_{max} + B\sqrt{\rho\eta\omega_{max}} - \frac{1}{\omega_{max}C_s}\right)^2 + \frac{1}{\omega_{max}C_p}\left(A\rho\omega_{max} + L_o\omega_{max} + B\sqrt{\rho\eta\omega_{max}} - \frac{1}{\omega_{max}C_s}\right) = 0 \quad \text{Eq. 20}$$

which can be solved for $\omega_{max}$ in a vacuum where $\rho$ equals zero, as shown in Eq. 21, as follows:

$$\omega_{max-vac}^2 = \left(\frac{1}{2}\left(\frac{R_o}{L_o}\right)^2 + \frac{1}{L_oC_s} + \frac{1}{2L_oC_p}\right) - \sqrt{\left(\frac{1}{2}\left(\frac{R_o}{L_o}\right)^2 + \frac{1}{L_oC_s} + \frac{1}{2L_oC_p}\right)^2 - \left(\frac{1}{L_o^2C_s^2} + \frac{1}{L_o^2C_sC_p}\right)} \quad \text{Eq. 21}$$

Equation 20 can also be solved as a quadratic equation as shown in Eq. 22 below, as follows:

$$\left(A\rho\omega_{max} + L_o\omega_{max} + B\sqrt{\rho\eta\omega_{max}} - \frac{1}{\omega_{max}C_s}\right) = \frac{1}{2\omega_{max}C_p} \pm \frac{1}{2}\sqrt{\left(\frac{1}{\omega_{max}C_p}\right)^2 + 4\left(R_o + B\sqrt{\rho\eta\omega_{max}}\right)^2} \quad \text{Eq. 22}$$

where the difference term is the solution for the maximum value, $\omega_{max}$ 1204, of the baseline corrected magnitude spectrum 1206. The sum term corresponds to the minimum value of this spectrum. Equation 22 can be rearranged to make it similar to equation 19, as shown in Eq. 23 below, as follows:

$$1 + \frac{A}{L_o}\rho + \frac{B}{L_o}\sqrt{\frac{\rho\eta}{\omega_{max}}} = \left(\frac{\omega_{max-vac}}{\omega_{max}}\right)^2 - \sqrt{\left(\frac{1}{2\omega_{max}^2L_oC_p}\right)^2 + \left(\frac{R_o}{\omega_{max}L_o} + \frac{B}{L_o}\sqrt{\frac{\rho\eta}{\omega_{max}}}\right)^2} \quad \text{Eq. 23}$$

Subtracting equation 19 from equation 23 yields Eq. 24, below as follows:

$$\sqrt{\rho\eta} = \frac{PQ + \frac{R_o}{L_o\omega_{max}^{3/2}} - \sqrt{\left\{PQ + \frac{R_o}{L_o\omega_{max}^{3/2}}\right\}^2 - \left[P^2 - \frac{1}{\omega_{max}}\right]\left[Q^2 - \left(\frac{1}{2\omega_{max}^2L_oC_p}\right)^2 - \left(\frac{R_o}{L_o\omega_{max}}\right)^2\right]}}{\frac{B}{L_o}\left[P^2 - \frac{1}{\omega_{max}}\right]} \quad \text{Eq. 24}$$

where $$P = \left(\frac{1}{\sqrt{\omega_o}} - \frac{1}{\sqrt{\omega_{max}}}\right)$$

and $$Q = \left[\left(\frac{\omega_{o-vac}}{\omega_o}\right)^2 - \left(\frac{\omega_{o-vac}}{\omega_{max}}\right)^2\right].$$

If an assumption is made that the tuning fork can be calibrated in an environment where there is no limitation on hardware or bandwidth then $\omega_{45-vac}$ and $\omega_{s-vac}$ can be measured to remove the unknowns $R_o$ and $L_o$ from equation 24, as shown in Eq. 25, below, as follows:

$$\sqrt{\rho\eta} = \frac{PQ\sqrt{\omega_o} + 2\left(\frac{S}{\omega_{max}^{3/2}}\right)\sqrt{\omega_o} - \sqrt{\omega_o\left\{2\frac{PS}{\omega_{max}} + \frac{Q}{\sqrt{\omega_{max}}}\right\}^2 + \left(1 - 2\sqrt{\frac{\omega_o}{\omega_{max}}}\right)\left(\frac{\omega_{o-vac}^2 - \omega_{s-vac}^2}{\omega_{max}^2}\right)^2}}{\frac{B}{L_o}\left(\frac{1}{\sqrt{\omega_o}} - \frac{2}{\sqrt{\omega_{max}}}\right)} \quad \text{Eq. 25}$$

where $S=\omega_{s-vac}-\omega_{45-vac}$. The density can then be determined from equation 19, as shown below in Eq. 26, $$\rho = \left(\frac{\left(\frac{\omega_{o-vac}}{\omega_o}\right)^2 - \frac{B}{L_o}\sqrt{\frac{\rho\eta}{\omega_o}} - 1}{\frac{A}{L_o}}\right) \quad \text{Eq. 26}$$

Therefore, the admittance of a tuning fork immersed in a fluid can be estimated directly in terms of density and viscosity. It does not matter whether the admittance of a tuning fork is measured with a phase sensitive detector or an amplitude detector, as an illustrative embodiment provides solutions to the electrical equivalent model.

In an illustrative embodiment, the system and method provide measurements of a tuning fork spectrum that will measure density and viscosity through interpretation of an admittance spectrum data stored in data structures 1300 and 1400 embedded in a computer readable medium. The data structures provide a functional and structural interrelationship between the data structure, data stored in the data structure and the computer hardware and software provided in an illustrative embodiment. Data from the tuning fork can be telemetered from the tool as subset 2. Shown in FIG. 13 is an illustrative embodiment of a data structure referred to as subset 2 for storing the telemetered data in a computer readable medium. Subset 2 data is a forty-one point array of frequencies, transmitter or TX amplitudes, and receiver or RX values. Data structures are provided for storing all data collected, calculated, measured and stored in an illustrative embodiment.

Before subset 2 is interpreted a complete spectrum is constructed. In order to reduce the measurement time and the amount of data telemetered in these subsets the data for one measurement is divided between three frequency tables. The hardware steps through theses tables and when data is requested it sends one table in a data structure as shown in FIG. 13. A complete spectrum is therefore constructed by interleaving the data from three acquisitions according to their buffer index. FIG. 14 is an illustrative embodiment of a data structure containing data for a complete spectrum as constructed from subset 2 interleaved according to buffer index.

In an illustrative embodiment, the method and system perform functions on the data set stored in the data structure, described as follows:

Interpretation

Constants:

NOP=the number of points in a spectrum (123 for subsets 2 and 3 variable for subset 6)

Rcal=100,000 ohms, the gain resistor value

Inputs:

Vratio[i]=NOP point array of data containing voltage ratios. (Dimensionless)

Freq[i]=NOP point array of data containing frequencies. (Hz)

Imaginary[i]=NOP point array of imaginary component of scaled admittance. (Dimensionless)

Real[i]=NOP point array of real component of scaled admittance. (Dimensionless)

Outputs:

ρ=density (g/cm$^3$)

η=viscosity (mPa-sec)

$C_p$=static capacitance (pF)

Calibration Coefficients:

$C_{p\text{-}cal}$=static capacitance in air or vacuum. (pF)

M=density calibration coefficient ((ohm-sec-cm$^3$)/g)

N=density-viscosity product calibration coefficient (cm$^3$/(g-mPa-sec$^2$))$^{1/2}$ $f_{s\text{-}air}$=frequency of series resonance in air (or vacuum) (Hz)

$f_{o\text{-}air}$=freq. where scaled admittance of resonant fork equals scaled static capacitance in air. (Hz)

$f_{45\text{-}air}$=freq. where real component of admittance equals imaginary component in air. (Hz)

Variables:

Y2[i]=NOP point array of scaled admittance values. (Dimensionless)

$C_{approx}$=scaled static capacitance (Hz$^{-1}$)

$f_x$=frequency at which scaled admittance is a maximum value. (Hz)

$f_o$=freq. where scaled admittance of resonant fork equals scaled static capacitance. (Hz)

$f_{45}$=freq. where real component of admittance equals imaginary component. (Hz)

$f_{shift}$, W and Z=temporary vars. To simplify notation

Procedure:

1) Upload calibration coefficients from tool memory. Each coefficient is a 16 character string in the following order: $C_{p\text{-}cal}$, M, N, $f_{s\text{-}air}$, $f_{o\text{-}air}$, and $f_{45\text{-}air}$.
2) Construct admittance arrays from interleaved frequency tables for subset 2 data
3) Calculate density and viscosity from admittance spectra.

$$Vratio[i] = \frac{RX[i]}{TX[i]}$$

$$C_{approx} = \frac{1}{10}\left(\sum_{i=0}^{4} \frac{Vratio[i]}{Freq[i]} + \sum_{i=NOP-5}^{NOP-1} \frac{Vratio[i]}{Freq[i]}\right)$$

$$Y2[i] = (Vratio[i])^2 - (C_{approx} Freq[i])^2$$

$$f_x = FREQ[\mathrm{MAX}(Y2[0:NOP-1])]$$

$$f_0 = FREQ[ZEROVAL(Y2[0:NOP-1])]$$

where MAX is a function that finds the index of the maximum value in an array, and ZEROVAL is a function that finds the index of the zero crossing of the values in an array. An illustrative embodiment limits the search for the zero crossing to indices greater than the index returned by the MAX function $$f_{shift} = \left(\frac{f_{o-air}}{f_0}\right)^2 - \left(\frac{f_{o-air}}{f_x}\right)^2$$

$$W = f_{s-air} - f_{45-air}$$

$$Z = f_{o-air}^2 - f_{s-air}^2$$

$$\rho\eta = \left[\frac{\left(1-\sqrt{\frac{f_o}{f_x}}\right)f_{shift} + 2\sqrt{\frac{f_o}{f_x}}\left(\frac{W}{f_x}\right) - \sqrt{\left\{2\left(1-\sqrt{\frac{f_o}{f_x}}\right)\left(\frac{W}{f_x}\right) + \sqrt{\frac{f_o}{f_x}}\, f_{shift}\right\}^2 + \left(1-2\sqrt{\frac{f_o}{f_x}}\right)\left(\frac{Z^2}{f_x^4}\right)}}{N\left(\frac{1}{\sqrt{f_o}} - \frac{2}{\sqrt{f_x}}\right)}\right]^2$$

$$\rho = \frac{\left(\frac{f_{o-air}}{f_o}\right)^2 - 1 - N\sqrt{\frac{\rho\eta}{f_o}}}{M}$$

$$\eta = \frac{\rho\eta}{\rho}$$

$$C_p = \frac{C_{approx}}{2\pi R_{cal}}$$

Flexural mechanical resonators such as tuning forks, benders, etc. are applied to liquid characterization. Additional complex electrical impedance produced by a liquid environment to such resonators is also described. This additional impedance can be represented by the sum of two terms: one that is proportional to liquid density and a second one that is proportional to the square root the of viscosity density product. This impedance model is universally applicable to any resonator type that directly displaces liquid and has size much smaller than the acoustic wavelength in a liquid at its operation frequency. Using this model it is possible to separately extract liquid viscosity and density values from the flexural resonator frequency response, while conventional TSM resonators can measure only the viscosity density product.

An alternative illustrative embodiment applies equations 13 and 14 or 25 and 26 to the admittance spectrum of a thickness-shear mode (TSM) resonator, or any piezoelectric transducer immersed in a fluid. Because the electrical equivalent model illustrated in FIG. 6 applies to any piezoelectric transducer. The sensitivity of the transducer will be indicated by the size of the A and B coefficients in the fluid impedance.

The flexural mechanical oscillator generates a signal which is utilized to determine formation fluid properties and transmits the signal to a processor or intelligent completion system (ICE) 30 for receiving, storing and processing the signal or combination of signals.

Figure 5:
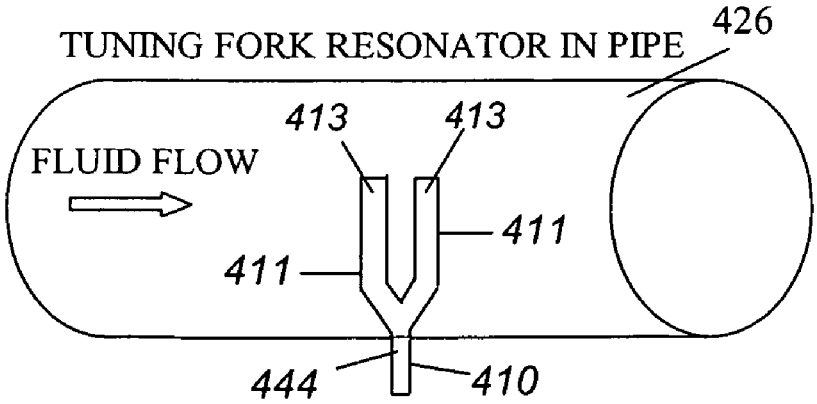
FIG. 5 is a schematic diagram of another particular illustrative embodiment illustrating a tuning fork as deployed in a fluid flow pipe.

FIG. 5 is a schematic diagram of an embodiment of another particular illustrative embodiment illustrating a tuning fork 412 with tines 411 deployed in a fluid flow pipe 426. A hard coating 444 can be added to turning fork 410 or other mechanical resonator to reduce the effects of abrasion. A coating 444 can also be applied to control the electrical conductivity at the surface of the resonator 410. A coating 444 can also be applied to reduce the quantity of particles or films adhering to the surface of the resonator.

As shown in FIG. 4, another particular illustrative embodiment can be utilized in flowing fluid, as when a sample of well bore fluid or formation fluid is pumped through the tool and into the well bore. In this scenario, where fluid is pumped through the tool, the mechanical resonator, which can be a bar bender, disk bender, cantilever, tuning fork, micro-machined membrane, torsion resonator, or any piezoelectric transducer is immersed in the flowing fluid and used to determine the density, viscosity and dielectric constant for the fluid flowing in the tool. In an embodiment, baffles are provided in the flow path to protect the mechanical resonator from the physical stress of the flowing fluid. A porous, sintered metal cap or a screen can also be used to cover the mechanical oscillator and protect it from pressure pulses and particles of sand or other solids.

In a second scenario of operation the fluid sample flowing in the tool is stopped from flowing by stopping the pump 412 while the mechanical resonator is immersed in the fluid and used to determine the density, viscosity and dielectric constant for the static fluid trapped in the tool.

Samples are taken from the formation by pumping fluid from the formation into a sample cell. Filtrate from the borehole normally invades the formation and consequently is typically present in formation fluid when a sample is drawn from the formation. As formation fluid is pumped from the formation the amount of filtrate in the fluid pumped from the formation diminishes over time until the sample reaches its lowest level of contamination. This process of pumping to remove sample contamination is referred to as sample clean up. In an embodiment, another particular illustrative embodiment indicates that a formation fluid sample clean up is complete when the viscosity or density has leveled off or become asymptotic within the resolution of the measurement of the tool for a period of twenty minutes to one hour. A density or viscosity measurement is also compared to a historical measure of viscosity or density for a particular formation and or depth in determining when a sample is cleaned up. That is, when a sample reaches a particular level or value for density and or viscosity in accordance with a historical value for viscosity and or density for the formation and depth the sample is determined to have been cleaned up to have reached a desired level of purity.

The bubble point pressure for a sample is indicated by that pressure at which the measured viscosity for formation fluid sample decreases abruptly. The dew point is indicated by an abrupt increase in viscosity of a formation fluid sample in a gaseous state. The asphaltene precipitation pressure is that pressure at which the viscosity decreases abruptly. For purposes of this disclosure, an abrupt increase or decrease can be in but is not limited to the range of a 50-100% change in the rate of increase or decrease in a measurement.

Another particular illustrative embodiment also enables calibration of a plurality of pressure gauges at depth. Pressure gauges are typically very sensitive to changes but not accurate as to absolute pressure. That is, a pressure gauge can accurately determine a change of 0.1 PSI but not capable of accurately determining whether the pressure changed from 1000.0 to 1000.1 PSI or 1002.0 to 1002.1 PSI. That is, the precision is better than the accuracy in the pressure gauges. In an embodiment, another particular illustrative embodiment enables determination of the absolute pressure difference between pressure gauges in a downhole tool. Another particular illustrative embodiment enables determination of the density of the fluid. Since the distance between the downhole pressure gauges is known, one can determine what the pressure difference or offset should be between the pressure gauges at a particular pressure and temperature. This calibration value or offset is added to or subtracted from the two pressure gauge readings. The calibration value is calculated in a nonconductive fluid, such as oil and can be applied when measuring pressure differential in conductive fluid, such as water where the tuning fork will not measure density or in the non-conductive fluid.

In an embodiment, the dielectric constant is calculated for a formation fluid sample. Another particular illustrative embodiment utilizes these calculations to calculate density and viscosity. Another particular illustrative embodiment provides a chemometric equation derived from a training set of known properties to estimate formation fluid parameters. Another particular illustrative embodiment provides a neural network derived from a training set of known properties to estimate formation fluid parameters. For example, from a measured viscosity, a chemometric equation can be used to estimate NMR properties $T_1$ and $T_2$ for a sample to improve an NMR measurement made independently in the tool. The chemometric equation is derived from a training set of samples for which the viscosity and NMR $T_1$ and $T_2$ are known. Any soft modeling technique is applicable with another particular illustrative embodiment.

Another particular illustrative embodiment is utilized to provide density, viscosity, dielectric coefficient and other measured or derived information available from the tool of another particular illustrative embodiment to a processor or intelligent completion system (ICS) 30 at the surface. The ICS is a system for the remote, intervention less actuation of downhole completion equipment has been developed to support the ongoing need for operators to lower costs and increase or preserve the value of the reservoir. Such a system is described in The Oil and Gas Journal, Oct. 14, 1996. These needs are particularly important in offshore environments where well intervention costs are significantly higher than those performed onshore. For example, traditional methods for setting a production packer employ coiled tubing or slick line to run a tubing plug.

The new system provides a safe, reliable and more cost efficient alternative to this method because it simply transmits acoustic pulses through the contents of tubulars to actuate one or more completion or service tools remotely in any desired sequence. The system not only decreases the sampling time and the time the packer is set, and also extends the envelope for application to deep, extended-reach offshore environments. Since the system eliminates the need to circulate a ball downhole to set service tools during sand control operations, the operator can maintain constant hydrostatic pressure on the formation. This capability decreases completion time, intervention risk, the possibility of formation collapse against the completion string, the possibility of losing the filter cake placed against the formation, and fluid loss to the formation.

To achieve the goals required for this system, three project targets were addressed: a reliable means of wireless communication, a surface control system, and a downhole power unit for completion device actuation. The design and capabilities of the new surface-operated, non-intervention completion system will facilitate economic completions in situations where more complex systems could not be justified, thus increasing the scope of application for 'intelligent well' technology.

At times called "SmartWells," these completion systems enable oil and gas companies to study and control individual zones without well intervention. This can dramatically lower operating expenditures by reducing downtime. Also, it can allow enhanced hydrocarbon recovery via improved reservoir management. ICSs enable the operator to produce, monitor and control the production of hydrocarbons through remotely operated completion systems. These systems are developed with techniques that allow the well architecture to be reconfigured at will and real-time data to be acquired without any well intervention.

The operator, located at the surface and having access to over ride the processor/ICE 30 may make his own decisions and issue commands concerning well completion based on the measurements provided by another particular illustrative embodiment. Another particular illustrative embodiment may also provide data during production logging to determine the nature of fluid coming through a perforation in the well bore, for example, the water and oil ratio.

The foregoing examples of illustrative embodiments are for purposes of example only and is not intended to limit the scope of the invention.

What is claimed is:

1. A method for estimating a property of a fluid down hole, the method comprising:

immersing a resonator in the fluid downhole;

sweeping an input voltage to the resonator over a frequency range;

measuring an electrical current output from the resonator over the frequency range;

determining admittance spectrum values for the resonator as the ratio of the electrical output current over the input voltage over the frequency range wherein the admittance spectrum values further comprise a difference between measured admittance values and a shunt admittance value due to stray capacitance;

determining a first frequency for the admittance spectrum;

determining a second frequency for the admittance spectrum; and estimating the property independently for the fluid down hole from the first and second frequencies.

2. The method of claim 1, wherein the admittance spectrum values are real and imaginary components of measured admittance values; and the first frequency is a frequency at which an imaginary component of the admittance spectrum values is at a maximum and the second frequency is a frequency at which a real component of the admittance spectrum values is at a maximum value.

3. The method of claim 1, wherein the admittance spectrum values are magnitudes of measured admittance values; and the first frequency is a frequency at which the magnitude of the admittance is at a maximum and wherein the second frequency is a frequency at which the magnitude of the admittance spectrum values crosses a baseline.

4. The method of claim 1, wherein the shunt admittance value is calculated as an average value of an imaginary component of the admittance spectrum.

5. The method of claim 1, wherein the shunt admittance value is calculated as an average value of the magnitudes of the measured admittance values.

6. The method of claim 1, wherein the property of the fluid is selected from the group consisting of density and viscosity.

7. The method of claim 1, further comprising:

subtracting a shunt admittance value from squared values of the magnitude of the measured admittance to calculate baseline corrected admittance values, wherein the first frequency is the frequency at which the baseline corrected admittance values crosses zero and the second frequency is a frequency at which the baseline corrected admittance has a maximum value.

8. The method of claim 1, the method further comprising:

estimating the property of the fluid by comparing the first frequency and the second frequency to frequencies stored in a data structure wherein the data structure indicates the fluid properties associated with the first and second frequency.

9. A system for estimating a property of a fluid down hole, the system comprising:

a resonator immersed in the fluid downhole;

a processor in data communication with the resonator;

a voltage source electrically connected to the resonator that provides a swept input voltage to the resonator over a frequency range;

a sensor for measuring an electrical current output from the resonator over the frequency range; and a computer program comprising computer executable instructions to determine admittance spectrum values for the resonator as the ratio of the electrical output current over the input voltage over the frequency range; instructions to determine a first frequency for the admittance spectrum wherein the admittance spectrum values further comprise a difference between measured admittance values and a shunt admittance value due to stray capacitance;

instructions to determine a second frequency for the admittance spectrum; and instructions to estimate the property independently for the fluid down hole from the first and second frequencies.

10. The system of claim 9, the computer program further comprising instructions to process the measured admittance values as real and imaginary components, wherein the first frequency is a frequency at which an imaginary component of the admittance spectrum is at a maximum and the second frequency is a frequency at which a real component of the admittance spectrum is at a maximum value.

11. The system of claim 9, the computer program further comprising: instructions to, calculate the magnitudes of measured admittance values, wherein the first frequency is a frequency at which the magnitude of the admittance is at a maximum and the second frequency is a frequency at which the magnitude of the admittance values crosses a baseline.

12. The system of claim 9 wherein the shunt admittance value is calculated as an average value of an imaginary component of the admittance spectrum.

13. The system of claim 9, wherein the shunt admittance value is calculated as an average value of the magnitudes of the measured admittance values.

14. The system of claim 9, wherein the property of the fluid is selected from the group consisting of density and viscosity.

15. The system of claim 9, the computer program further comprising: instructions to subtract a shunt admittance value from squared values of the magnitude of the measured admittance to calculate baseline corrected admittance values, wherein the first frequency is the frequency at which the baseline corrected admittance crosses zero and the second frequency is a frequency at which the baseline corrected admittance has a maximum value.

16. The system of claim 9, the computer program further comprising instructions to estimate the property of the fluid by comparing the first frequency and the second frequency to frequencies stored in a data structure, wherein the data structure indicates the fluid properties associated with the first and second frequency.

* * * * *